US010140900B2

(12) United States Patent
Kim et al.

(10) Patent No.: US 10,140,900 B2
(45) Date of Patent: Nov. 27, 2018

(54) DATA DRIVER, DISPLAY DEVICE INCLUDING THE DATA DRIVER AND METHOD OF DRIVING THE DISPLAY DEVICE WITH DIFFERENT GAMMA DATA

(71) Applicant: SAMSUNG DISPLAY CO., LTD., Yongin-si, Gyeonggi-do (KR)

(72) Inventors: Won Tae Kim, Yongin-si (KR); Soo Yeon Kim, Yongin-si (KR); Young Il Ban, Yongin-si (KR); Sun Kyu Son, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 151 days.

(21) Appl. No.: 15/018,044

(22) Filed: Feb. 8, 2016

(65) Prior Publication Data

US 2016/0365020 A1 Dec. 15, 2016

(30) Foreign Application Priority Data

Jun. 11, 2015 (KR) ..... 10-2015-0082755

(51) Int. Cl.
*G09G 5/10* (2006.01)
*G09G 3/20* (2006.01)

(52) U.S. Cl.
CPC ..... *G09G 3/20* (2013.01); *G09G 2310/027* (2013.01); *G09G 2310/0291* (2013.01); *G09G 2320/0673* (2013.01)

(58) Field of Classification Search
CPC ... G09G 3/3688; G09G 3/3607; G09G 3/3291
See application file for complete search history.

(56) References Cited

U.S. PATENT DOCUMENTS 8,174,515 B2 5/2012 Jeong et al.
8,339,301 B2 12/2012 Na et al.
8,823,618 B2 9/2014 Lee et al.
(Continued)

FOREIGN PATENT DOCUMENTS

CN 103218968 7/2013
KR 1020030005748 1/2003
(Continued)

*Primary Examiner* — Jonathan Blancha
(74) *Attorney, Agent, or Firm* — F. Chau & Associates, LLC

(57) ABSTRACT

A data driver includes a gamma unit, a digital-to-analog converter, and an output buffer. The gamma unit receives at least one reference voltage, and generates a first gamma reference voltage corresponding to a first sub-pixel and a second gamma reference voltage corresponding to a second sub-pixel using the received at least one reference voltage. The digital-to-analog converter receives the first and second gamma reference voltages from the gamma unit, and generates a first gamma data value corresponding to the first sub-pixel using the first gamma reference voltage and a second gamma data value corresponding to the second sub-pixel using the second gamma reference voltage. The output buffer outputs a first frame including the first gamma data value and a second frame including the second gamma data value. The output buffer outputs the first and second frames in a repeated manner for every predetermined number of frames.

18 Claims, 15 Drawing Sheets

(56) References Cited

U.S. PATENT DOCUMENTS

| | | | | |
|---|---|---|---|---|
| 2004/0125422 | A1* | 7/2004 | Wang | G09G 3/3696 358/519 |
| 2006/0220572 | A1* | 10/2006 | Seki | G09G 3/2025 315/100 |
| 2013/0321483 | A1* | 12/2013 | You | G09G 5/10 345/690 |
| 2014/0078188 | A1* | 3/2014 | Hwang | G09G 3/3622 345/690 |
| 2015/0179103 | A1* | 6/2015 | Tani | G09G 3/20 345/690 |
| 2015/0235620 | A1* | 8/2015 | Takahota | G09G 5/10 345/690 |

FOREIGN PATENT DOCUMENTS

| | | |
|---|---|---|
| KR | 1020100005929 | 1/2010 |
| KR | 1020100007077 | 1/2010 |

* cited by examiner

DATA DRIVER, DISPLAY DEVICE INCLUDING THE DATA DRIVER AND METHOD OF DRIVING THE DISPLAY DEVICE WITH DIFFERENT GAMMA DATA

CROSS-REFERENCE TO RELATED APPLICATION

This application claims priority under 35 U.S.C. § 119 to Korean Patent Application No. 10-2015-0082755, filed on Jun. 11, 2015, in the Korean Intellectual Property Office, the disclosure of which is incorporated by reference herein in its entirety.

TECHNICAL FIELD

The present invention relates to a display device and a method of driving the display device.

DISCUSSION OF THE RELATED ART

Display devices have been used for computer monitors, televisions, cellular phones, or the like. The display devices include a liquid crystal display (LCD), a plasma display panel (PDP), an organic light emitting display (OLED), or the like. As a resolution and a size of the display device increase, transmission amount and speed of data may also increase.

A display device may have a gamma characteristic in which luminance of an image displayed in the display device does not linearly increase according to a level of an input signal applied to a pixel. Thus, gamma correction may be performed in the display device based on a gamma curve.

SUMMARY

According to an exemplary embodiment of the present invention, a data driver is provided. The data driver includes a gamma unit, a digital-to-analog converter, and an output buffer. The gamma unit receives at least one reference voltage, and generates a first gamma reference voltage corresponding to a first sub-pixel of a pixel and a second gamma reference voltage corresponding to a second sub-pixel of the pixel using the received at least one reference voltage. The digital-to-analog converter receives the first and second gamma reference voltages from the gamma unit, and generates a first gamma data value corresponding to the first sub-pixel using the first gamma reference voltage and a second gamma data value corresponding to the second sub-pixel using the second gamma reference voltage. The output buffer outputs a first frame including the first gamma data value and a second frame including the second gamma data value. The output buffer outputs the first and second frames in a repeated manner for every predetermined number of frames.

Each of the first and second sub-pixels may include a red sub-pixel, a green sub-pixel, or a blue sub-pixel.

The at least one reference voltage may include a first gamma voltage, a second gamma voltage, a third gamma voltage, and a fourth gamma voltage.

The gamma unit may generate the first gamma voltage using an analog driving voltage, generate the second gamma voltage and the third gamma voltage using a half of the analog driving voltage, generate the fourth gamma voltage using a ground voltage, and generate the first and second gamma reference voltages using the generated first to fourth gamma voltages.

The output buffer may output the first and second frames using a single amplifier.

The output buffer may output the first and second gamma data values by adjusting an output time duration of at least one of the first and second frames.

The output buffer may adjust the output time duration of the at least one of the first and second frames by a unit of at least three frames, and output the first and second gamma data values by adjusting the output time duration of the at least one of the first and second frames.

According to an exemplary embodiment of the present invention, a display device is provided. The display device includes a display unit, a gate driver, and a data driver. The display unit includes a light emitting device. The gate driver applies a gate voltage to the display unit. The data driver includes a gamma unit, a digital-to-analog converter, and an output buffer. The gamma unit receives at least one reference voltage, and generates a first gamma reference voltage corresponding to a first sub-pixel of a pixel and a second gamma reference voltage corresponding to a second sub-pixel of the pixel using the received at least one reference voltage. The digital-to-analog converter receives the first and second gamma reference voltages from the gamma unit, and generates a first gamma data value corresponding to the first sub-pixel using the first gamma reference voltage and a second gamma data value corresponding to the second sub-pixel using the second gamma reference voltage. The output buffer outputs a first frame including the first gamma data value and a second frame including the second gamma data value. The output buffer outputs the first and second frames in a repeated manner for every predetermined number of frames.

Each of the first and second sub-pixels may include a red sub-pixel, a green sub-pixel, or a blue sub-pixel.

The at least one reference voltage may include a first gamma voltage, a second gamma voltage, a third gamma voltage, and a fourth gamma voltage.

The gamma unit may generate the first gamma voltage using an analog driving voltage, generate the second gamma voltage and the third gamma voltage using a half of the analog driving voltage, generate the fourth gamma voltage using a ground voltage, and generate the first and second gamma reference voltages using the generated first to fourth gamma voltages.

The output buffer may output the first and second gamma data values by adjusting an output time duration of at least one of the first and second frames.

The output buffer may output the first and second frames using a single amplifier.

The output buffer may adjust the output time duration of the at least one of the first and second frames by a unit of at least three frames, and output the first and second gamma data values by adjusting the output time duration of the at least one of the first and second frames.

According to an exemplary embodiment of the present invention, a method of driving a display device is provided. The method includes receiving at least one reference voltage, and generating a first gamma reference voltage corresponding to a first sub-pixel of a pixel and a second gamma reference voltage corresponding to a second sub-pixel of the pixel using the received at least one reference voltage, generating a first gamma data value corresponding to the first sub-pixel using the first gamma reference voltage and a second gamma data value corresponding to the second sub-pixel using the second gamma reference voltage, outputting a first frame including the first gamma data value and a second frame including the second gamma data value. The first and second frames may be output in a repeated manner for every predetermined number of frames.

According to an exemplary embodiment of the present invention, a data driver is provided. The data driver includes a gamma unit, a digital-to-analog converter, and an output buffer. The gamma unit receives at least one reference voltage, and generates first through third gamma reference voltages respectively corresponding to first through third sub-pixels of a pixel using the received at least one reference voltage. The first through third sub-pixels respectively correspond to image data having a same grayscale value. The digital-to-analog converter receives the first through third gamma reference voltages from the gamma unit, and generates a first gamma data value corresponding to the first sub-pixel using the first gamma reference voltage, a second gamma data value corresponding to the second sub-pixel using the second gamma reference voltage, and a third gamma data value corresponding to the third sub-pixel using the third gamma reference voltage. The output buffer outputs a first frame including the first gamma data value, a second frame including the second gamma data value, and a third frame including the third gamma data value. The first through third frames are disposed in a sequential manner.

The output buffer may output the first through third frames in a repeated manner for every predetermined number of frames.

The output buffer may output the first through third frames using a single amplifier.

The output buffer may output the first and second gamma data values by adjusting an output time duration of at least one of the first through the third frames.

The first through third sub-pixels may represent different colors from each other.

BRIEF DESCRIPTION OF THE DRAWINGS

Exemplary embodiments of the present invention will now be described more fully with reference to the accompanying drawings in which.

DETAILED DESCRIPTION OF THE EMBODIMENTS

Figure 1:
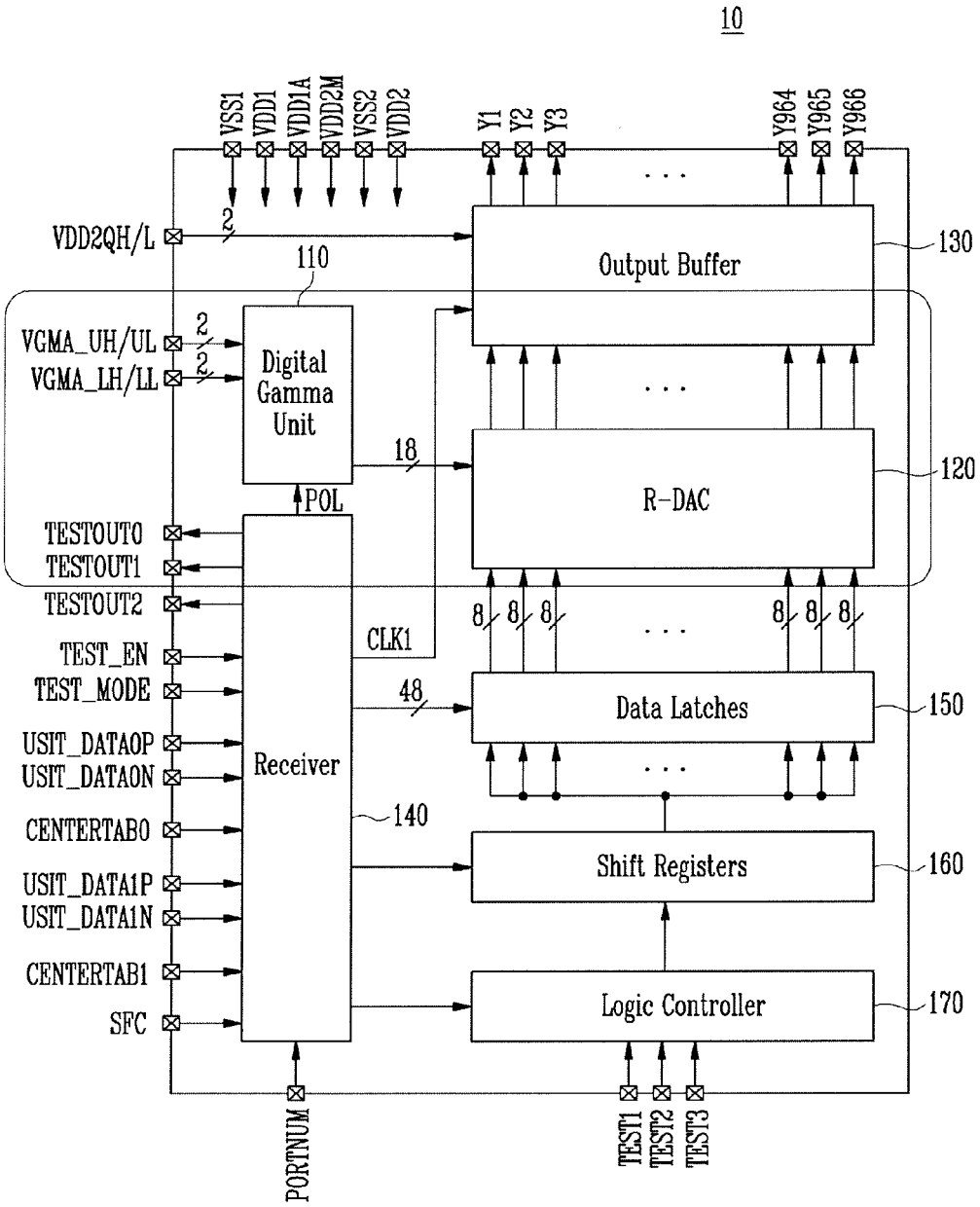
FIG. 1 is a diagram illustrating a data driver.

Hereinafter, exemplary embodiments of the present invention will be described in detail with reference to the accompanying drawings.

It will be understood that the present invention, however, may be embodied in various forms, and should not be construed as being limited to the embodiments set forth herein. Like reference numerals may refer to like elements throughout this application. All the elements throughout the specification and drawings may be circuits. As used herein, singular forms such as "a," "an," and "the", are intended to include plural forms as well, unless the context clearly indicates otherwise.

In the entire specification, when an element is referred to as being "connected" or "coupled" to another element, it can be directly connected or coupled to the another element or be indirectly connected or coupled to the another element with one or more intervening elements interposed therebetween.

A display device according to an exemplary embodiment of the present invention may include a display unit, a data driver, and a gate driver, a controller, or the like. The data driver and gate driver drive the display unit. The controller controls the data driver and the gate driver. Hereinafter, the data driver may be referred to as the "source integrate circuit (IC)", or vice versa.

The display unit is a display area displaying an image. The display area includes a plurality of pixels. According to an exemplary embodiment of the present invention, the display unit may be an organic light emitting display panel or a liquid crystal display (LCD). In addition, the display unit may include a plurality of gate lines G1 to Gn for transmitting a plurality of gate signals (e.g., scan signals) and a plurality of data lines D1 to Dm for transmitting a plurality of data signals. The plurality of gate lines G1 to Gn may extend in a first direction (e.g., a lateral direction), and the plurality of data lines D1 to Dn may extend in a second direction (e.g., a longitudinal direction) crossing the first direction.

At least one gate line G1 to Gn and at least one data line D1 to Dm may be connected to one of the plurality of pixels. Each pixel may include a switching device connected to the at least one gate line G1 to Gn and the at least one data line D1 to Dm, and a driving transistor and a light emitting device, which are connected to the switching device. A control terminal of the switching device may be connected to the gate line G1 to Gn, an input terminal of the switching device may be connected to the data line D1 to Dm, and an output terminal of the switching device may be connected to the driving transistor. A data voltage transmitted through the switching device may adjust an amount of current output from the driving transistor, and the light emitting device may emit light based on the corresponding amount of current. The connection relationship between the driving transistor and the light emitting device may vary according to an exemplary embodiment of the present invention. According to an exemplary embodiment of the present invention, the pixel may include a red sub-pixel R emitting red light, a green sub-pixel G emitting green light, and a blue sub-pixel B emitting blue light.

Figure 2A:
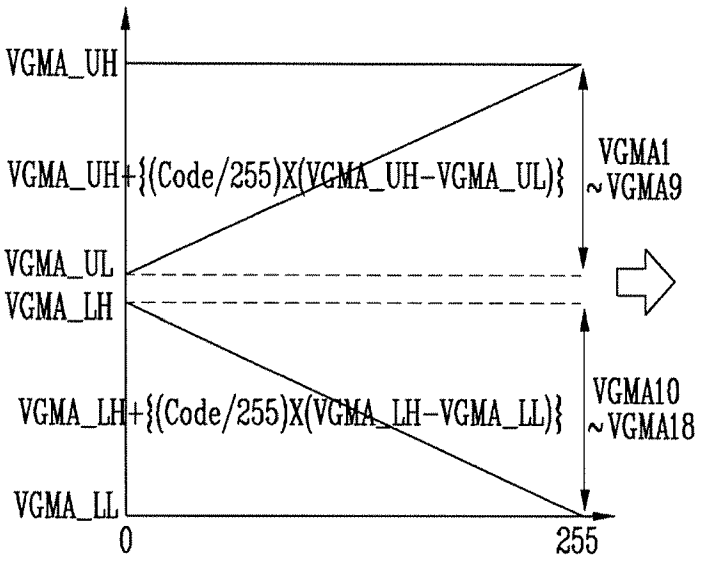
FIGS. 2A and 2B are diagrams illustrating a digital gamma curve generated by the data driver of FIG. 1.
Figure 2B:
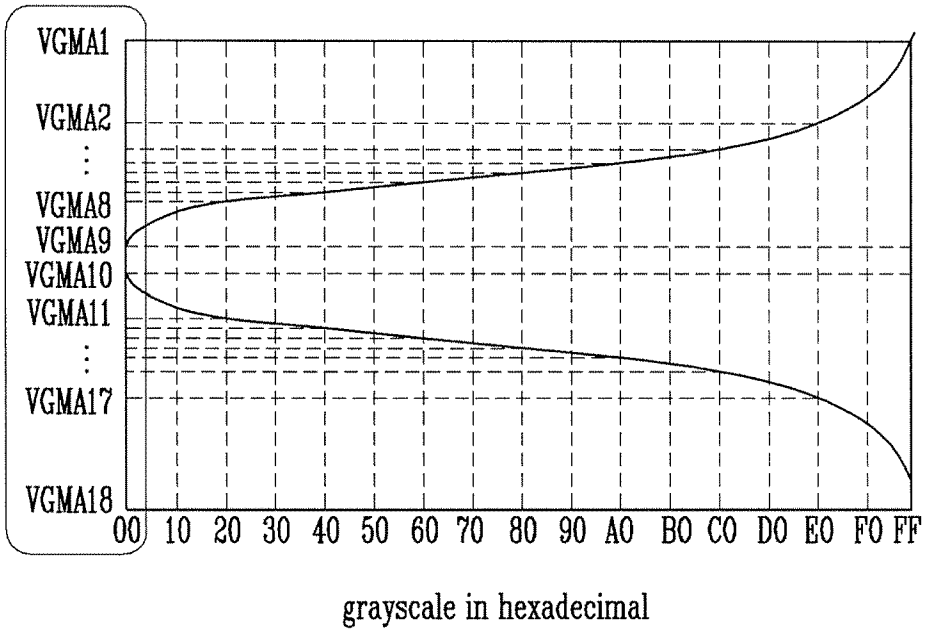
Figure 3:
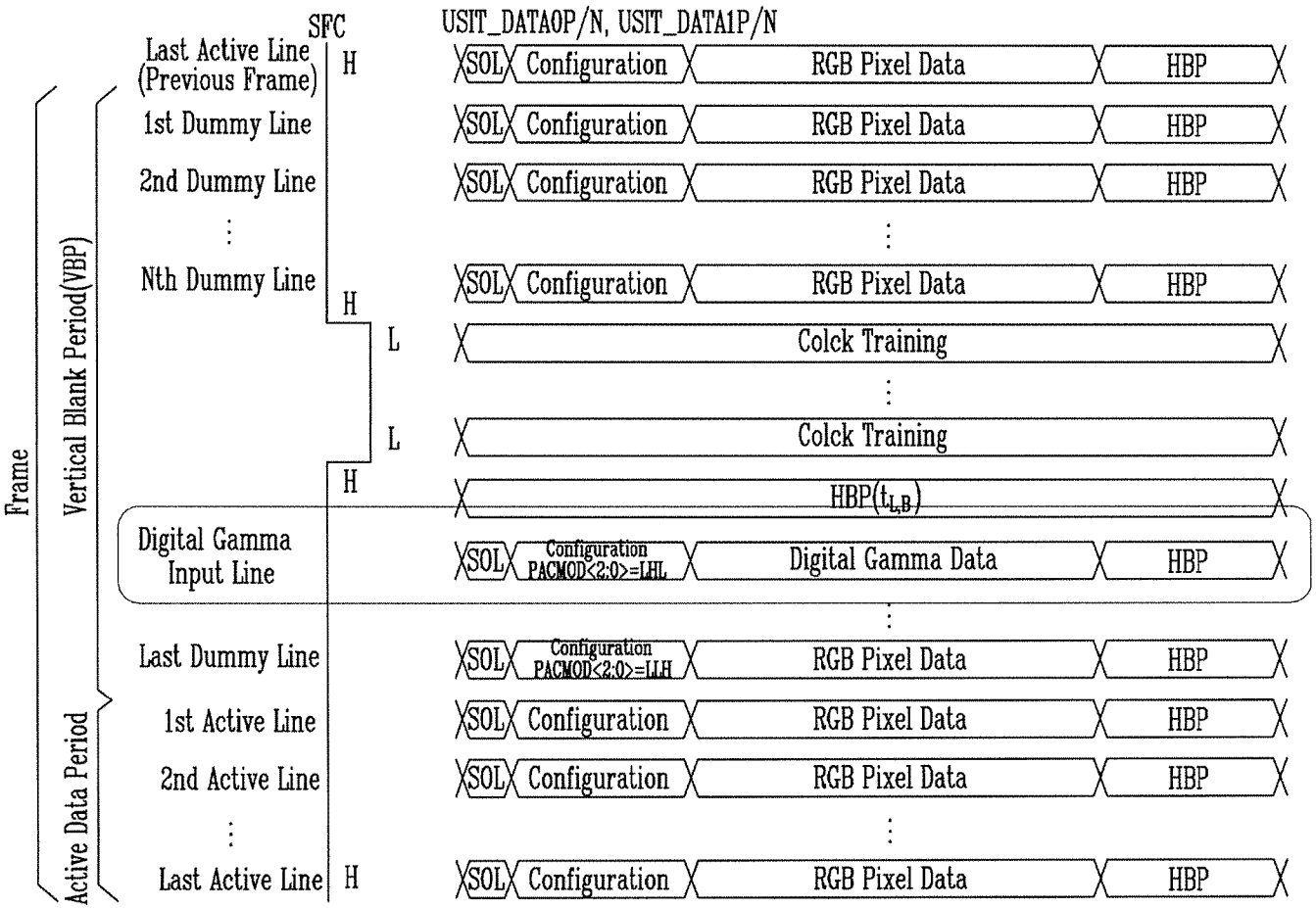
FIG. 3 is a diagram illustrating a configuration of a single frame output from the data driver of FIG. 1.
Figure 4:
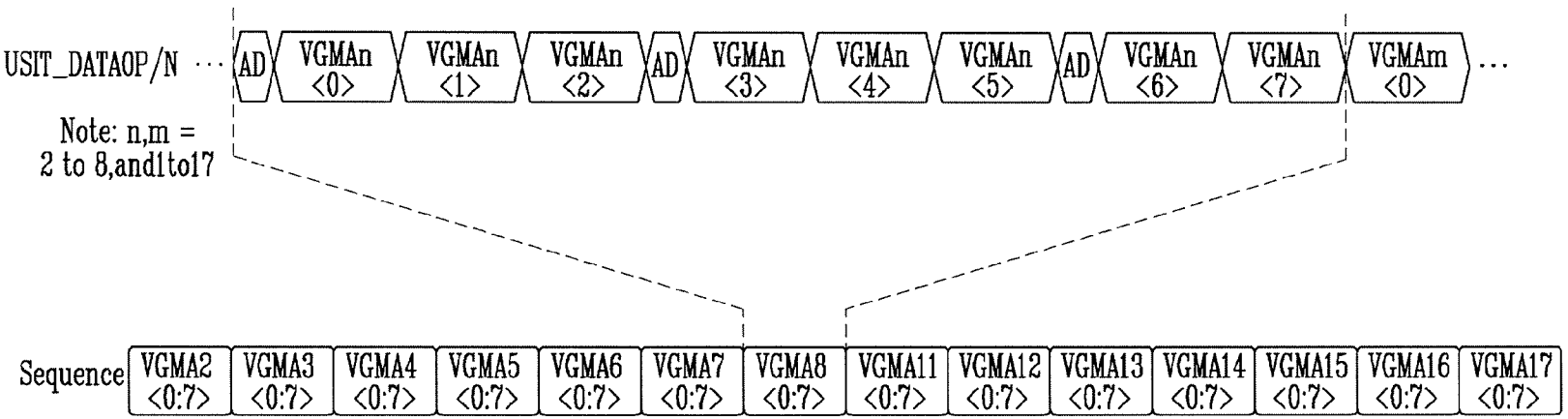
FIG. 4 is a diagram illustrating a data sequence.

FIG. 1 is a diagram illustrating a data driver 10. FIGS. 2A and 2B are diagrams illustrating a digital gamma curve generated by the data driver 10 of FIG. 1. FIG. 3 is a diagram illustrating a configuration of a single frame output from the data driver of FIG. 1. FIG. 4 is a diagram illustrating a data sequence.

Referring to FIG. 1, the data driver 10 may include a digital gamma unit 110, a register string digital-to-analog converter (R-DAC) 120, an output buffer 130, or the like. The data driver may further include a receiver 140, shift registers 160, data latches 150, a logic controller 170, or the like. In this case, the receiver 140 may be a unified standard interface for TV (USI_T) receiver, and receive data from a timing controller (TCON). The receiver 140 may output data to the data latches 150, the shift registers 160, and the logic controller 170. The shift registers 160 may receive clock signals and input/output control signals from, e.g., the receiver 140, and generate a pulse signal for every predetermined number of clock signals. The data latches 150 may receive data and load signals, and latch the data according to a shift order of the shift registers 160. In response to the load signal, the data latches 150 may output data. Referring to FIG. 1, an interface between the TCON (e.g., a signal control IC) and the data driver 10 (e.g., a data drive IC) may include, for example, a USI_T interface, etc. For example, an interface between the TCON and the data driver may be the USI_T interface.

The receiver 140 may receive data through a plurality of input ports (e.g., TEST_EN, TEST_MODE, USIT_DATA0P, USIT_DATA0N, CENTERTAB0, USIT_DATA1P, USIT_DATA1N, CENTERTAB1, SFC, PORTNUM) and output data through a plurality of output ports (e.g., TESTOUT0 through TESTOUT2). The logic controller 170 may receive test signals TEST1 through TEST3. The output buffer 130 may output image signals Y1 through Y966. The data driver 10 may be supplied with voltages such as, e.g., VSS1, VDD1, VDD1A, VDD2M, VSS2, VDD2, VDD2QH/L).

In this case, the digital gamma unit 110 may receive at least one (e.g., 4) reference voltages from the outside of the data driver 10, and generate 18 voltages using the at least one reference voltage. In addition, the digital gamma unit 110 may transmit the generated 18 voltages to the R-DAC 120. The 4 reference voltages may include a first gamma voltage VGMA_UH, a second gamma voltage VGMA_UL, a third gamma voltage VGMA_LH, and a fourth gamma voltage VGMA_LL.

Referring to FIG. 2A, the digital gamma unit 110 generates gamma reference voltages according to bits (e.g., 8 bits, 10 bits, etc.) configuring the gamma reference voltages using the reference voltages received from the outside. Referring to FIG. 2B, y-axis represents the gamma reference voltages and x-axis represent grayscale values in hexadecimal. For example, the digital gamma unit 110 may receive the 4 reference voltages such as VGMA_UH, VGMA_UL, VGMA_LH, and VGMA_LL from the outside. In this case, the digital gamma unit 110 may generate gamma reference voltages VGMA1 to VGMA9 using the reference voltages VGMA_UH and VGMA_UL. The gamma reference voltage VGMA1 may correspond to the reference voltage VGMA_UH, and the gamma reference voltage VGMA9 may correspond to the reference voltage VGMA_UL. In addition, the digital gamma unit 110 may generate gamma reference voltages VGMA10 to VGMA18 using the reference voltages VGMA_LH and VGMA_LL. The gamma reference voltage VGMA10 may correspond to the reference voltage VGMA_LH, and the gamma reference voltage VGMA 18 may correspond to the reference voltage VGMA_LL.

The 18 gamma reference voltages generated by the digital gamma unit 110 may be transmitted to the R-DAC 120. The R-DAC 120 may determine output values through a preset R-string, using the received 18 gamma reference voltages VGMA1 through VGMA18. Referring to FIG. 2B, the R-DAC 120 may determine output values through the predetermined R-string. The output values of the R-DAC 120 may constitute a curved gamma correction curve. In addition, the R-DAC 120 may transmit the determined output values to the output buffer 130.

Therefore, referring to FIGS. 3 and 4, the data driver may transmit the same digital gamma data to a pixel unit in every frame according to a signal transmitted through the interface. For example, as shown in FIG. 3, the same digital gamma data may be included in every frame, which, for example, is output from the data driver 10 and will be transmitted to the pixel unit. The digital gamma data in the frames may be the same as each other. In this case, the same digital gamma data may be transmitted in a period (e.g., a vertical blank period (VBP) in the case of a start frame control (SFC) signal) in which no data signal is output in a frame. The digital gamma data may be input to a digital gamma input line and transmitted during the VBP.

Referring to FIG. 3, a single frame may include a plurality of data packets respectively corresponding to a plurality of data lines and a digital gamma input line. Each data packet corresponding to each of the plurality of data lines includes a line start field SOL, a configuration field, an RGB pixel data field, and a horizontal blank field HBP. The data packet corresponding to the digital gamma input line includes a line start field SOL, a configuration field, a digital gamma data field, and a horizontal blank field HBP. In addition, referring to FIG. 4, a sequence of a gamma reference voltage is illustrated. For example, the sequence may include gamma reference voltages VGMA 2 to VGMA 8 and VGMA 11 to VGMA 17.

When the same gamma data is included in every frame to be transmitted as described above (e.g., when the same gamma curve is used in every frame), a data driver (e.g., 10 of FIG. 1 or a source IC) is operated based on the same gamma curve for red (R), green (G), and blue (B) sub-pixels. For example, the data driver may be operated based on the same gamma curve for R, G, and B sub-pixels when image data respectively applied to the R, G, and B sub-pixels have the same grayscale value. In this case, R, G and B data may simultaneously be output. Therefore, when the same gamma curve is used in driving R, G, and B sub-pixels, the implementation of colors may be limited. In addition, when a gamma curve is implemented in a software manner such as dithering, a real target gamma curve (e.g., a gamma curve close to a real value) might not be implemented.

Figure 5:
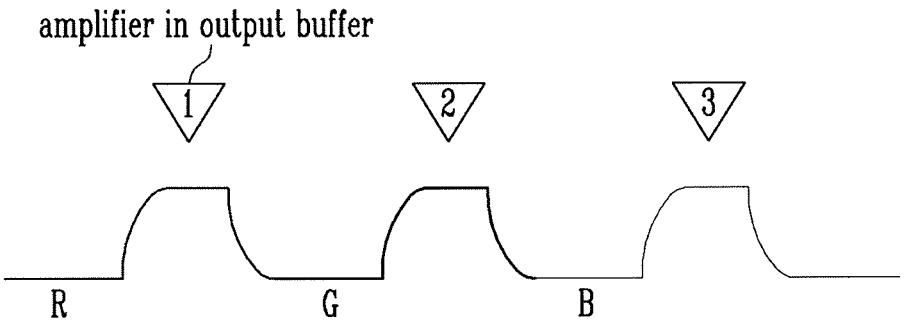
FIG. 5 is a diagram illustrating an output of a data driver.
Figure 6:
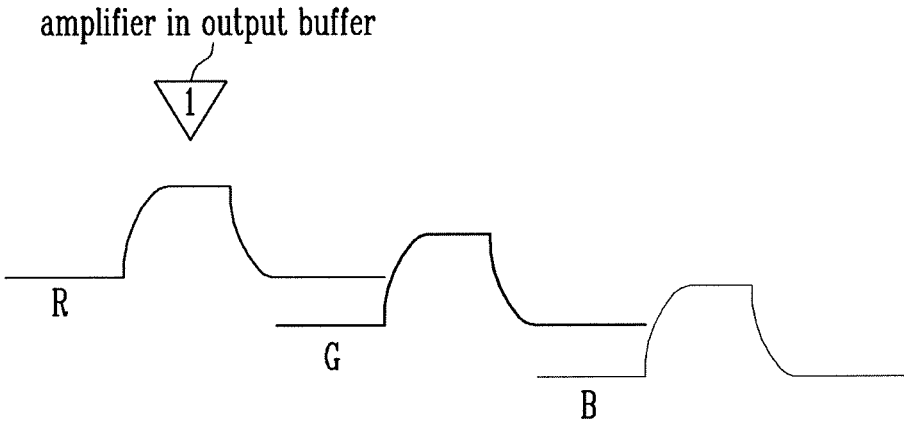
FIG. 6 is a diagram illustrating an output of a data driver according to an exemplary embodiment of the present invention.

FIG. 5 is a diagram illustrating an output of a data driver (e.g., 10 of FIG. 1 or a source IC). FIG. 6 is a diagram illustrating an output of a data driver (e.g., 20 of FIG. 7 or a source IC) according to an exemplary embodiment of the present invention.

Referring to FIG. 5, R, G, and B sub-pixels are simultaneously driven to respectively output R, G, and B colors by the data driver (e.g., 10 of FIG. 1, a source IC). In addition, the same gamma curve is used to drive the R, G, and B sub-pixels.

As shown in FIG. 6, in the data driver (e.g., 20 of FIG. 7, a source IC) according to an exemplary embodiment of the present invention, gamma curves may separately be set for the respective R, G, and B sub-pixels. For example, in a display panel structure according to an exemplary embodiment of the present invention, when a pixel includes R, G, and B sub-pixels, gamma curves respectively corresponding to the R, G, and B sub-pixels may be generated in a separate manner. In addition, R, G, and B gamma data values may be output in a sequential and repeated manner during a plurality of frames. For example, an R digital gamma value corresponding to the R sub-pixel may be output in a first frame, a G digital gamma value corresponding to the G sub-pixel may be output in a second frame, and a B digital gamma value corresponding to the B sub-pixel may be output in a third frame. In addition, the R digital gamma value may be output in a fourth frame, the G digital gamma value may be output in a fifth frame, and the B digital gamma value may be output in a sixth frame. Therefore, the R, G, and B digital gamma values may be output in a repeated manner.

Referring to FIG. 5, the data driver (e.g., 10 of FIG. 1 or a source IC) which drives R, G, and B sub-pixels simultaneously may be driven with, for example, a frame rate of 60 Hz. In this case, the output signal of an amplifier (e.g., an output amplifier of the data driver) may have the frame rate of 60 Hz. When the gamma curves are separately set for the respective R, G, and B sub-pixels according to an exemplary embodiment of the present invention, an output frame rate of an amplifier in the data driver (e.g., 20 of FIG. 7 or a source IC) may be increased in proportion to the number of gamma curves set according to an exemplary embodiment of the present invention even though the data driver (e.g., 20 of FIG. 7) is driven with the same frame rate as that of the data driver (e.g., 10 of FIG. 1) described with reference to FIG. 5. For example, when the gamma curves are separately set for the respective R, G, and B sub-pixels, and the data driver (e.g., 20 of FIG. 7 or a source IC) may be driven with the frame rate of 60 Hz, the frame rate of the output signal of the amplifier of the data driver (e.g., 20 of FIG. 7) may be 180 Hz which is three (e.g., the number of set gamma curves) times the frame rate 60 Hz with which the data driver (e.g., 10 of FIG. 1) is driven. For example, the data driver (e.g., 10 of FIG. 1 or a source IC) described with reference to FIG. 5 may output each of R, G, and B data through each of a plurality of amplifiers in the data driver. For example, the data driver (e.g., 20 of FIG. 7 or a source IC) described with reference to FIG. 6 according to an exemplary embodiment of the present invention may output R, G, and B data through the same amplifier in the data driver. Accordingly, the number of output channels Ch of the data driver (e.g., 20 of FIG. 7) according to an exemplary embodiment of the present invention can be decreased to ⅓ compared to that of the data driver (e.g., 10 of FIG. 1) described with reference to FIG. 5.

Figure 7:
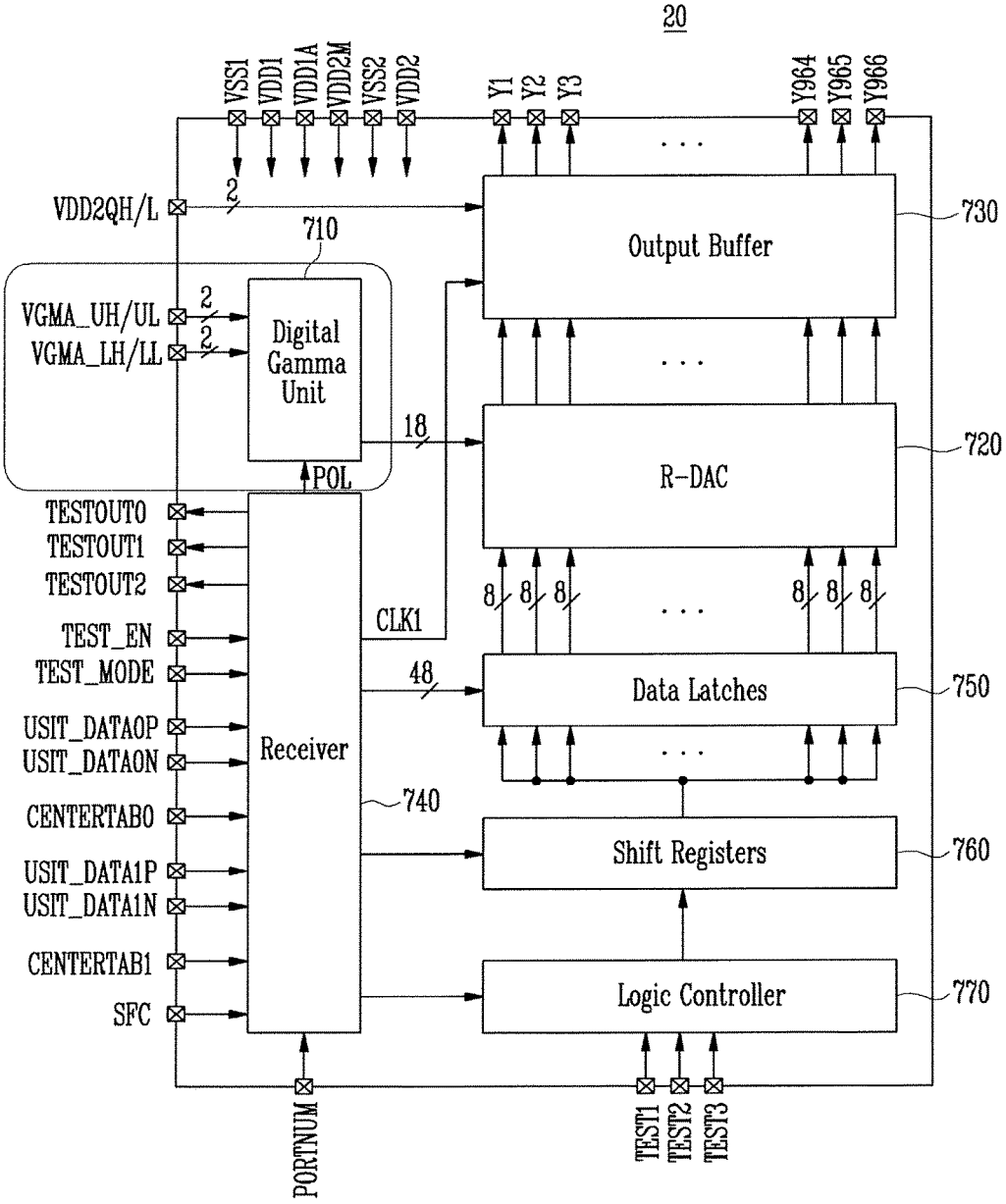
FIG. 7 is a diagram illustrating a data driver according to an exemplary embodiment of the present invention.
Figure 8:
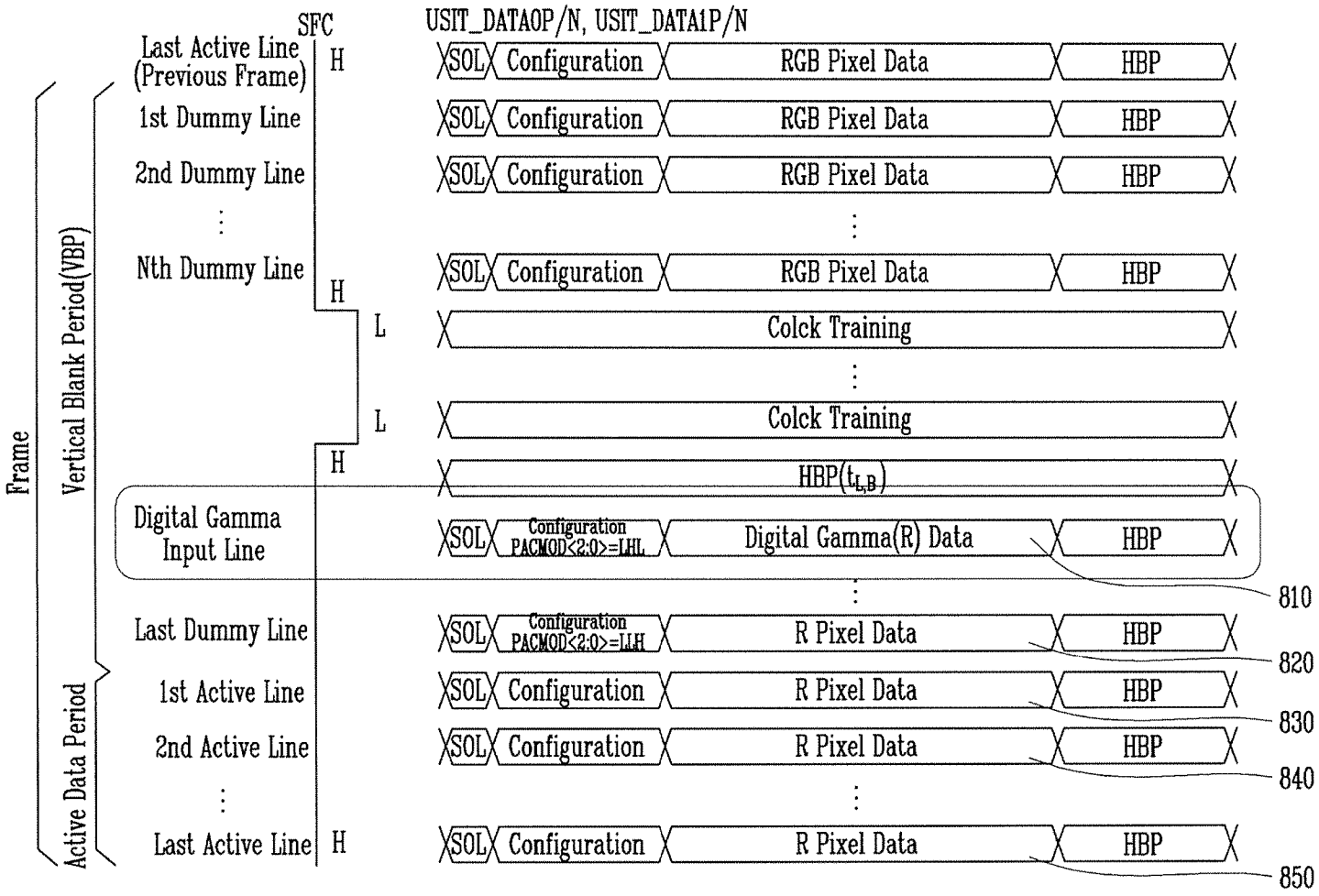
FIG. 8 is a diagram illustrating a configuration of a first frame output from the data driver of FIG. 7 according to an exemplary embodiment of the present invention.
Figure 9:
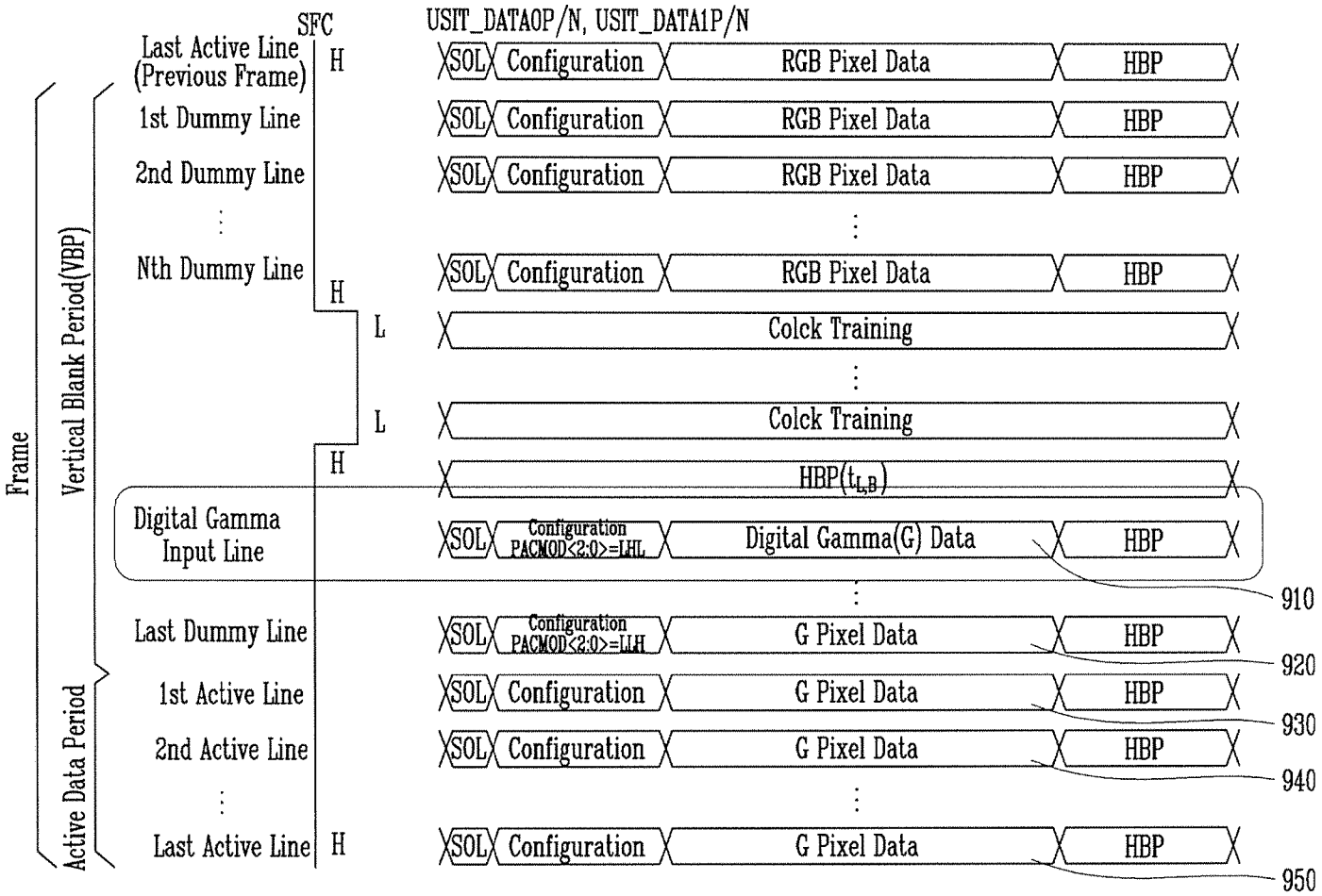
FIG. 9 is a diagram illustrating a configuration of a second frame output from the data driver of FIG. 7 according to an exemplary embodiment of the present invention.
Figure 10:
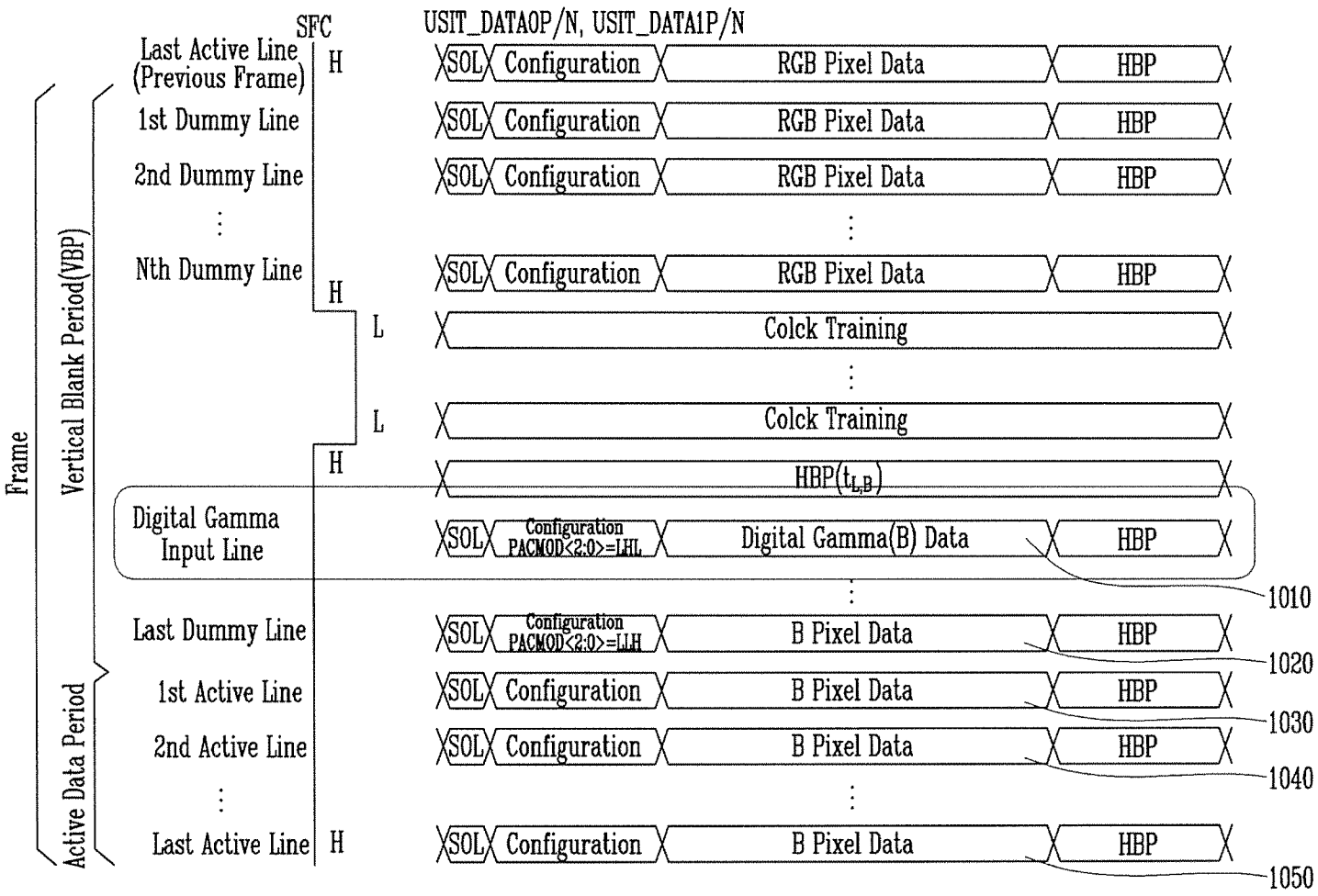
FIG. 10 is a diagram illustrating a configuration of a third frame output from the data driver of FIG. 7 according to an exemplary embodiment of the present invention.
Figure 11:
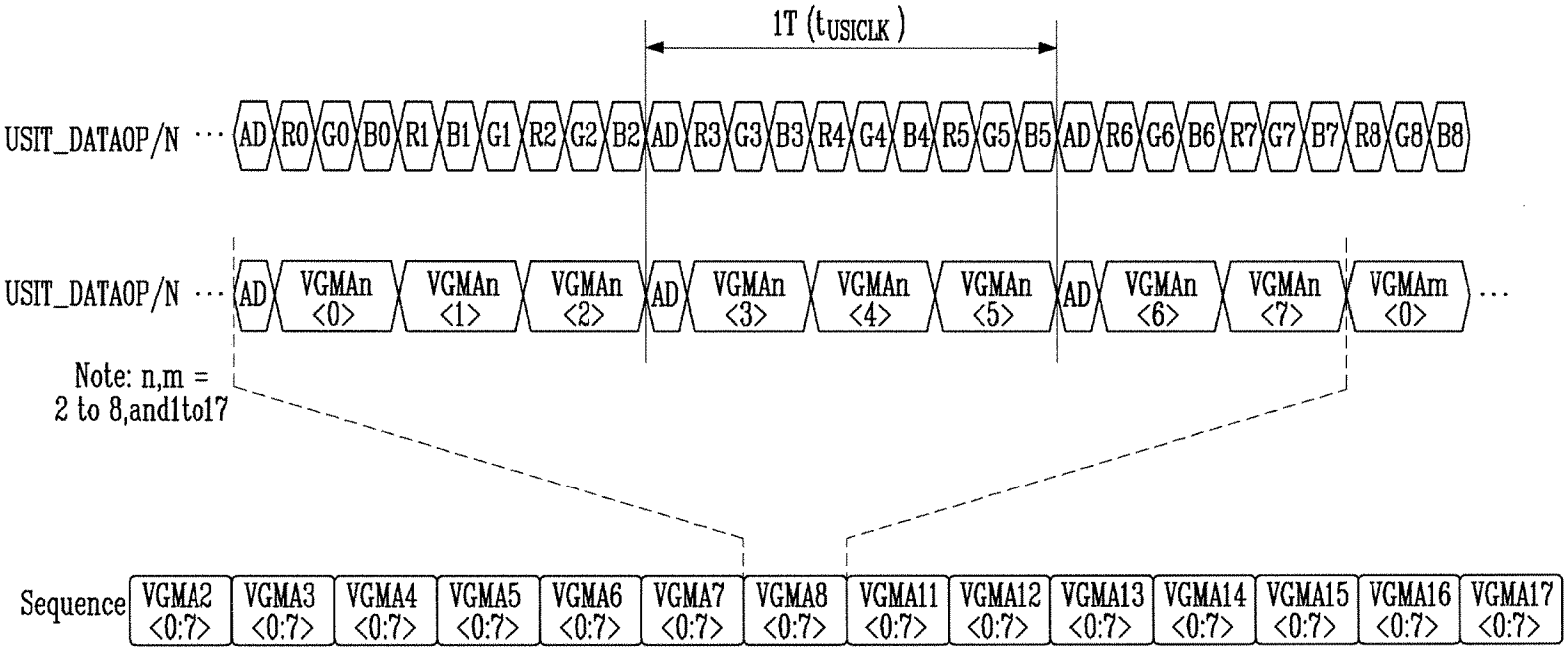
FIG. 11 is a diagram illustrating a data sequence according to an exemplary embodiment of the present invention.
Figure 12:
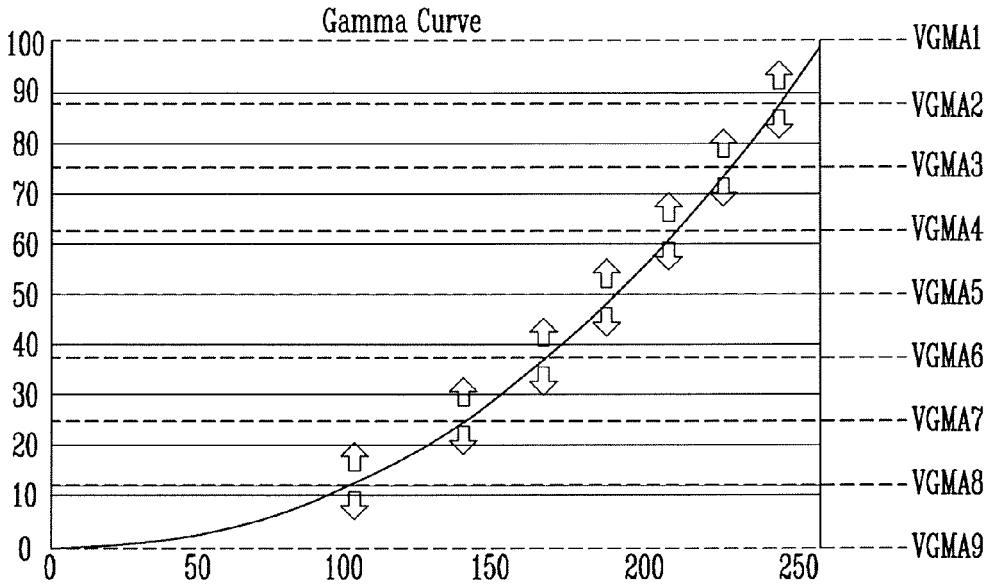
FIG. 12 is a diagram illustrating a digital gamma curve according to an exemplary embodiment of the present invention.

FIG. 7 is a diagram illustrating a data driver 20 according to an exemplary embodiment of the present invention. FIG. 8 is a diagram illustrating a configuration of a first frame output from the data driver 20 of FIG. 7 according to an exemplary embodiment of the present invention. FIG. 9 is a diagram illustrating a configuration of a second frame output from the data driver 20 of FIG. 7 according to an exemplary embodiment of the present invention. FIG. 10 is a diagram illustrating a configuration of a third frame output from the data driver 20 of FIG. 7 according to an exemplary embodiment of the present invention. FIG. 11 is a diagram illustrating a data sequence according to an exemplary embodiment of the present invention. FIG. 12 is a diagram illustrating a digital gamma curve according to an exemplary embodiment of the present invention.

Referring to FIG. 7, the data driver 20 according to an exemplary embodiment of the present invention may include a digital gamma unit 710, an R-DAC 720, an output buffer 730, or the like. According to an exemplary embodiment of the present invention, the data driver 20 may further include a receiver 740, shift registers 760, data latches 750, a logic controller 770, or the like. In an exemplary embodiment of the present invention, the receiver 740 may be a USI_T receiver, and receive data from a timing controller (TCON). The receiver 740 may output data to the data latches 750, the shift registers 760, and the logic controller 770. The shift registers 760 may receive clock signals and input/output control signals from, e.g., the receiver 740, and generate a pulse signal for every predetermined number of clock signals. The data latches 750 may receive data and load signals, and latch the data according to a shift order of the shift registers 760. In response to the load signal, the data latches 750 may output data. Referring to FIG. 7, an interface between the TCON (e.g., a signal control IC) and the data driver 20 (e.g., a data drive IC) may include, for example, a USI_T interface, etc. For example, an interface between the TCON and the data driver 20 may be the USI_T interface.

The receiver 740 may receive data through a plurality of input ports (e.g., TEST_EN, TEST_MODE, USIT_DATA0P, USIT_DATA0N, CENTERTAB0, USIT_DATA1P, USIT_DATA1N, CENTERTAB1, SFC, PORTNUM) and output data through a plurality of output ports (e.g., TESTOUT0 through TESTOUT2). The logic controller 770 may receive test signals TEST1 through TEST3. The output buffer 730 may output image signals Y1 through Y966. The data driver 20 may be supplied with voltages such as, e.g., VSS1, VDD1, VDD1A, VDD2M, VSS2, VDD2, VDD2QH/L).

In this case, the digital gamma unit 710 may receive at least one (e.g., 4) reference voltages from the outside of the data driver 20, and generate 18 gamma reference voltages using the at least one reference voltage. In addition, the digital gamma unit 710 may transmit the generated 18 gamma reference voltages to the R-DAC 720. According to an exemplary embodiment of the present invention, the 4 reference voltages may be a first gamma voltage VGMA_UH, a second gamma voltage VGMA_UL, a third gamma voltage VGMA_LH, and a fourth gamma voltage VGMA_LL. In this case, the gamma reference voltages may be differently set according to a panel structure. For example, the gamma reference voltages may be differently set based on characteristics of the respective R, G, and B sub-pixels.

For example, the digital gamma unit 710 generates gamma reference voltages according to bits (e.g., 8 bits, 10 bits, etc.) configuring the gamma reference voltages using the reference voltages received from the outside. A gamma curve may be determined based on the generated gamma reference. For example, the digital gamma unit 710 may receive 4 reference voltages such as VGMA_UH, VGMA_UL, VGMA_LH, and VGMA_LL from the outside. In this case, the digital gamma unit 710 may generate gamma reference voltages VGMA1 to VGMA9 using the reference voltages VGMA_UH and VGMA_UL. The gamma reference voltage VGMA1 may correspond to the reference voltage VGMA_UH, and The gamma reference voltage VGMA9 may correspond to the reference voltage VGMA_UL. In addition, the digital gamma unit 710 may generate the gamma reference voltages VGMA10 to VGMA18 using the reference voltages VGMA_LH and VGMA_LL. The gamma reference voltage VGMA10 may correspond to the reference voltage VGMA_LH, and the gamma reference voltage VGMA18 may correspond to the reference voltage VGMA_LL. In this case, the digital gamma unit 710 may differently generate gamma reference voltages according to a panel structure. For example, when a single pixel includes R, G, and B sub-pixels, the digital gamma unit 710 may differently generate gamma reference voltages based on characteristics of the respective R, G, and B sub-pixels. When the gamma reference voltage VGMA1 to VGMA9 are generated using the reference voltages VGMA_UH and VGMA_HL as shown in FIG. 12, the digital gamma unit 710 may differently generate the gamma reference voltages VGMA2 to VGMA8 according to characteristics of the respective R, G, and B sub-pixels.

The 18 gamma reference voltages generated by the digital gamma unit 710 may be transmitted to the R-DAC 720. The R-DAC 720 may determine output values through a predetermined R-string using the received 18 gamma reference voltages. In this case, the gamma reference voltages are differently generated for the respective R, G, and B sub-pixels as described above. Thus, the output values generated by the R-DAC 720 may be different for the respective R, G, and B sub-pixels. The R-DAC 720 may transmit the determined output values to the output buffer 730.

Accordingly, the data driver 20 can output R, G, and B gamma data values in a sequential and repeated manner during a plurality of frames according to a signal transmitted through the interface. For example, as shown in FIGS. 8 to 11, each of R, G, and B digital gamma data (e.g., R, G, and B gamma data values) determined for the respective R, G, and B sub-pixels may sequentially be included in each of the plurality of frames to be transmitted.

For example, as shown in FIG. 8, in a first frame, the data driver 20 may transmit the R digital gamma data 810 in a period (e.g., a VBP in the case of an SFC) in which no data signal is output. According to an exemplary embodiment of the present invention, the data driver 20 may transmit data 820, 830, 840, and 850 corresponding to the R sub-pixel in the first frame in which the R digital gamma data 810 is transmitted.

In a second frame subsequent to the first frame, as shown in FIG. 9, the data driver 20 may transmit G digital gamma data 910 in a period (e.g., a VBP in the case of an SFC) in which no data signal is output. According to an exemplary embodiment of the present invention, the data driver 20 may transmit data 920, 930, 940, and 950 corresponding to the G sub-pixel in the second frame in which the G digital gamma data 910 is transmitted.

In a third frame subsequent to the second frame, as shown in FIG. 10, the data driver 20 may transmit B digital gamma data 1010 in a period (e.g., a VBP in the case of an SFC) in which no data signal is output. According to an exemplary embodiment of the present invention, the data driver 20 may transmit data 1020, 1030, 1040, and 1050 corresponding to the B sub-pixel in the third frame in which the B digital gamma data 1010 is transmitted.

In addition, a fourth frame subsequent to the third frame may include R digital gamma data (e.g., 810) and data (e.g., 820, 830, 840, and 850) corresponding to the R sub-pixel. For example, the fourth frame may have substantially the same configuration as that of the first frame of FIG. 8. Thus, R, G, and B gamma data values may be output in a sequential and repeated manner during a plurality of frames. Although it has been described that gamma data values are sequentially output in the plurality of frames in an order of R, G, and B. However, the present invention is not limited thereto, and an order in which R, G, and B are output may vary. For example, the output order of the gamma data values may be an order of G, B, and R.

And, referring to FIG. 11, a sequence of a gamma reference voltage is illustrated. For example, the sequence may include gamma reference voltages VGMA 2 to VGMA 8 and VGMA 11 to VGMA 17. As shown in FIG. 11, digital gamma data determined for the respective R, G, and B may be included in the digital gamma data according to the present invention. According to an embodiment, an output signal clock $t_{USICLK}$ of source IC may operate by a unit of three frames.

As described above, the R, G, and B gamma data values are output in a sequential and repeated manner during the plurality of frames, and gamma curves are separately generated for the respective R, G, and B sub-pixels, and thus, luminance of a display device and a degree of freedom in expressing a grayscale may be increased. For example, the data driver 20 may be operated based on different gamma curves for the respective R, G, and B sub-pixels when image data respectively applied to the R, G, and B sub-pixels have the same grayscale value. For example, the data driver 20 may be operated based on different gamma reference voltages for the respective R, G, and B sub-pixels when image data respectively applied to the R, G, and B sub-pixels have the same grayscale value.

A configuration of a frame illustrated in each of FIGS. 8 through 10 have substantially the same as that illustrated in FIG. 3 except a data packet corresponding to the digital gamma input line.

Figure 13A:
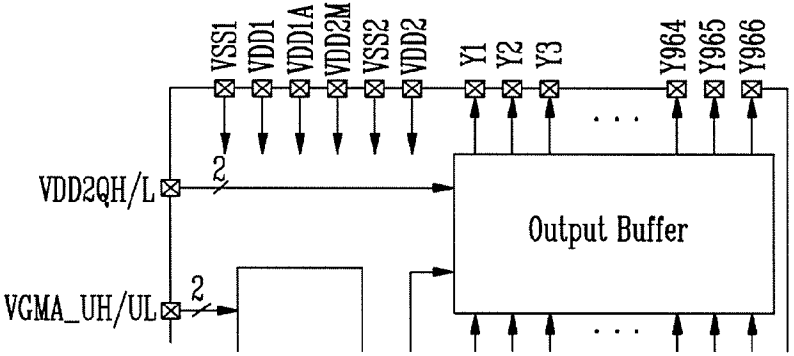
FIG. 13A is a diagram illustrating an output buffer of a data driver.
Figure 13B:
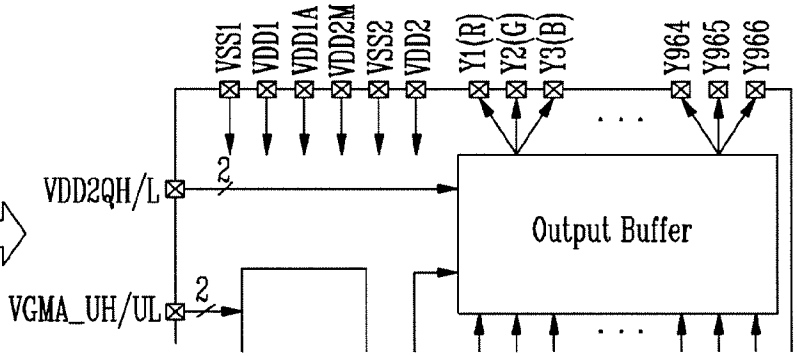
FIG. 13B is a diagram illustrating an output buffer of a data driver according to an exemplary embodiment of the present invention.
Figure 14B:
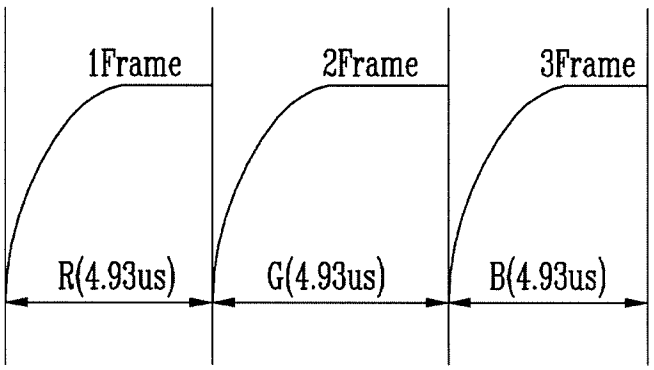
FIG. 14B is a diagram illustrating a single horizontal period (1H) waveform of data output from the output buffer of FIG. 13B according to an exemplary embodiment of the present invention.
Figure 14A:
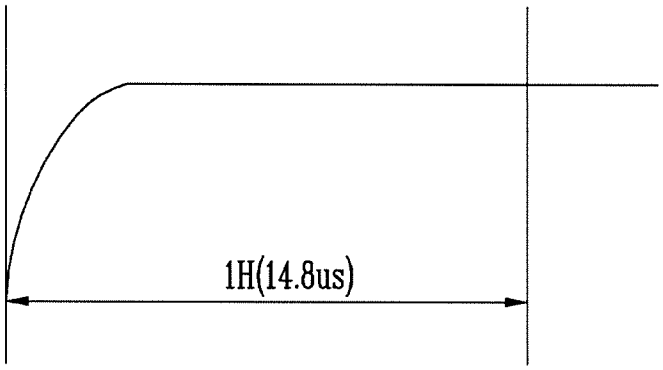
FIG. 14A is a diagram illustrating a single horizontal period (1H) waveform of data output from the output buffer of FIG. 13A.

FIG. 13A is a diagram illustrating a configuration of an output buffer of a data driver (e.g., 10 of FIG. 1), and FIG. 13B is a diagram illustrating a configuration of an output buffer of a data driver (e.g., 20 of FIG. 7) according to an exemplary embodiment of the present invention. FIG. 14A is a diagram illustrating a single horizontal period (1H) waveform of data output from the output buffer of FIG. 13A, and FIG. 14A is a diagram illustrating a 1H waveform of data output from the output buffer of FIG. 13B according to an exemplary embodiment of the present invention.

Referring to FIG. 13A, in the output buffer of the data driver (e.g., 10 of FIG. 1 or a source IC), each of R, G, and B data outputs is driven by each of a plurality of amplifiers in the output buffer. Referring to FIG. 13B, in the output buffer of the data driver (e.g., 20 of FIG. 7 or source IC), R, G, and B data outputs are driven by a single amplifier (e.g., the same amplifier) in the output buffer to output the R, G, and B data. For example, in the data driver (e.g., 10 of FIG. 1 or a source IC) described with reference to FIG. 13A, each amplifier of the output buffer outputs each of the R, G, and B data. According to an exemplary embodiment of the present invention, a single amplifier of the output buffer may drive R, G, and B data and sequentially output the R, G, and B data. Accordingly, the number of output channels (e.g., amplifiers) of the data driver described with reference to FIG. 13A can be reduced to ⅓ compared to that of the data driver described with reference to FIG. 13B.

FIG. 14A illustrates a 1H waveform of the R data output when the data driver (e.g., 10 of FIG. 1 or a source IC) is driven with the frame rate of 60 Hz. As shown in FIG. 14A, the 1H correspond to 14.8 μs. FIG. 14B illustrates a 1H waveform of the R, G, and B data outputs when the data driver (e.g., 20 of FIG. 7 or a source IC) is driven with the frame rate of 60 Hz. As shown in FIG. 14B, the 1H in the data driver (e.g., 20 of FIG. 7 or a source IC) is reduced to 4.93 μs (e.g., about 5 μs) that is ⅓ of the 1H in the data driver (e.g., 10 of FIG. 1 or a source IC).

Figure 15B:
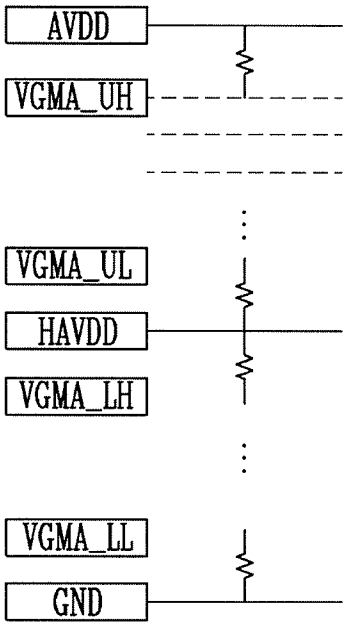
FIG. 15B is a diagram illustrating a configuration of an R-DAC according to an exemplary embodiment of the present invention.
Figure 15A:
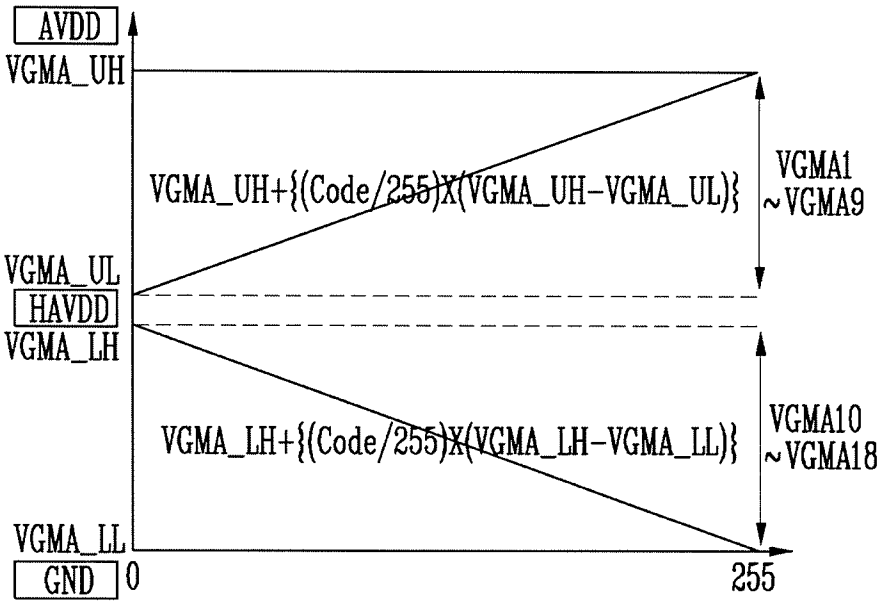
FIG. 15A is a diagram illustrating a digital gamma curve according to an exemplary embodiment of the present invention.
Figure 16:
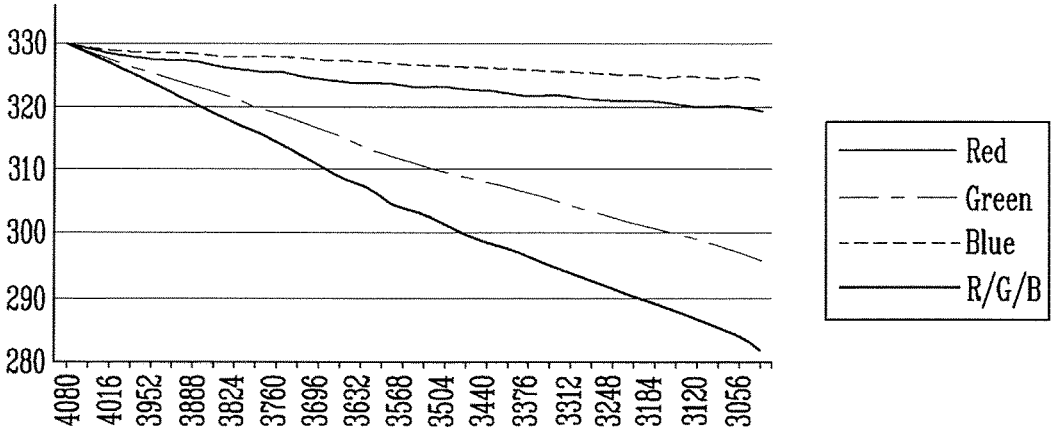
FIG. 16 is a diagram illustrating luminance changes of R, G, and B sub-pixels according to 255G data values.

FIG. 15A is a diagram illustrating a digital gamma curve according to an exemplary embodiment of the present invention, and FIG. 15B is a diagram illustrating a configuration of an R-DAC according to an exemplary embodiment of the present invention. FIG. 16 is a diagram illustrating luminance changes of R, G, and B sub-pixels according to 255G data values.

Referring to FIGS. 15A and 15B, the data driver (e.g., 20 of FIG. 7) according to an exemplary embodiment of the present invention may generate 18 gamma reference voltages, using, for example, four reference voltages input from the outside of the data driver. For example, the four reference voltages includes the first gamma voltage VGMA_UH, the second gamma voltage VGMA_UL, the third gamma voltage VGMA_LH, and the fourth gamma voltage VGMA_LL, and the data driver receives the gamma voltages from the outside and generates gamma reference voltages, using the gamma voltages (e.g., VGMA_UH, VGMA_UL, VGMA_LH, and VGMA_LL). According to an exemplary embodiment of the present invention, the data driver (e.g., 20 of FIG. 7) may generate the first gamma voltage VGMA_UH using an analog driving voltage AVDD. The second gamma voltage VGMA_UL and the third gamma voltage VGMA_LH may be generated using a half of the analog driving voltage (e.g., half AVDD or HAVDD). The fourth gamma voltage VGMA_LL may be generated using a ground voltage GND. In this case, the reference voltages (e.g., VGMA_UH, VGMA_UL, VGMA_LH, and VGMA_LL) used for generating the gamma output voltages are not fixed but variable depending on AVDD, HAVDD, and GND. Thus, luminance values respectively corresponding to R, G, and B sub-pixels may freely be changed.

Referring to FIG. 16, a luminance change according to a change in grayscale of respective R, G, and B sub-pixels and a luminance change according to a change in grayscale when R, G, and B sub-pixels are simultaneously output are illustrated. And, an amount of luminance change corresponding to the G sub-pixel is greater than those corresponding to the R and B sub-pixels. In addition, an amount of luminance change corresponding to the R sub-pixel is greater than that corresponding to the B sub-pixel. Thus, when the levels of some gamma voltages (e.g., VGMA_UH and VGMA_UL are changed for a fixed analog driving voltage AVDD, the amount of luminance change according to a change in grayscale may be compensated.

Figure 17:
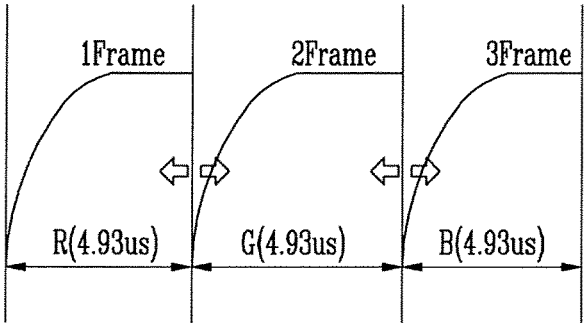
FIG. 17 is a diagram illustrating a 1H waveform of data output of an output buffer according to an exemplary embodiment of the present invention.

FIG. 17 is a diagram illustrating a 1H waveform of data output of an output buffer (e.g., the output buffer of FIG. 13B) according to an exemplary embodiment of the present invention.

In the output buffer of the data driver (e.g., 20 of FIG. 7) according to an exemplary embodiment of the present invention, a waveform and a gate may be influenced by an output order of the R, G, and B data of amplifiers respectively corresponding to the R, G, and B sub-pixels. Thus, time durations in which R, G, and B data are output may be changed (e.g., adjusted).

Referring to FIG. 17, a data driver (e.g., 20 of FIG. 7 or a source IC) may identically operate by a unit of three frames based on a clock signal CLK, and the output time durations of R, G, and B data may be changed by adjusting an output time duration of at least one frame among the three frames. For example, the three frames in which the R, G, and B data are respectively transmitted may be handled in one unit. Here, an output time duration corresponding to the three frames may be 14.8 μs, and the output time duration of each of R, G, and B data may be the same as 4.93 μs as shown in FIG. 17. In this case, the output time duration of at least one frame among the three frames may be adjusted. For example, the output time duration of R may be decreased to, e.g., about 4.5 μs, and the output time duration of G may be increased to, e.g., about 5.5 μs.

According to an exemplary embodiment of the present invention, the adjusting of the output time durations of the R, G, and B data may be implemented by a method that includes adjusting a clock signal CLK1 of an output amplifier in the interface, and the clock signal CLK1 may be configured with 6 bits. In this case, the output time durations of R, G, and B data may be adjusted by adjusting a rising time of the clock signal CLK1.

In a data driver (e.g., 20 of FIG. 7) according to an exemplary embodiment of the present invention, different gamma curves may be generated and used respectively for the R, G, and B sub-pixels, and thus, a degree of freedom in expressing a grayscale may be increased. In addition, at least one of output time durations of the R, G, and B sub-pixels may be adjusted. Thus, a size of a source IC may be reduced by controlling an output by a unit of at least one frame. For example, data of 2898 channels may be output through 966 channels (e.g., amplifiers). Further, a chip size of the source IC and the number of ICs may be reduced.

While exemplary embodiments of the present invention have been particularly shown and described, it will be understood that various changes in form and details may be made therein without departing from the spirit and scope of the present invention as set forth in the following claims.

What is claimed is:

1. A data driver comprising:

a gamma unit receiving at least one reference voltage, and generating a first gamma reference voltage corresponding to a first sub-pixel of a pixel and a second gamma reference voltage corresponding to a second sub-pixel of the pixel using the received at least one reference voltage, and generates separate gamma curves for each of the first sub-pixel and second sub-pixel;

a digital-to-analog converter receiving the first and second gamma reference voltages from the gamma unit, and generating a first gamma data value corresponding to the first sub-pixel using the first gamma reference voltage and a second gamma data value corresponding to the second sub-pixel using the second gamma reference voltage; and an output buffer outputting a first frame including the first gamma data value and a second frame including the second gamma data value, respectively, wherein the output buffer outputs the first and second frames in a repeated manner for every predetermined number of frames, wherein the output buffer outputs the first and second frames using a single amplifier, and wherein an output frame rate of the single amplifier is proportional to a number of gamma curves set.

2. The data driver of claim 1, wherein each of the first and second sub-pixels includes a red sub-pixel, a green sub-pixel, or a blue sub-pixel.

3. The data driver of claim 1, wherein the at least one reference voltage includes a first gamma voltage, a second gamma voltage, a third gamma voltage, and a fourth gamma voltage.

4. The data driver of claim 3, wherein the gamma unit generates the first gamma voltage using an analog driving voltage, generates the second gamma voltage and the third gamma voltage using a half of the analog driving voltage, generates the fourth gamma voltage using a ground voltage, and generates the first and second gamma reference voltages using the generated first to fourth gamma voltages.

5. The data driver of claim 1, wherein the output buffer outputs the first and second gamma data values by adjusting an output time duration of at least one of the first and second frames.

6. The data driver of claim 5, wherein the output buffer adjusts the output time duration of the at least one of the first and second frames in a unit of three frames, and outputs the first and second gamma data values by adjusting the output time duration of the at least one of the first and second frames.

7. A display device comprising:

a display unit including a light emitting device;

a gate driver applying a gate voltage to the display unit; and a data driver including:

a gamma unit receiving at least one reference voltage, and generating a first gamma reference voltage corresponding to a first sub-pixel of a pixel and a second gamma reference voltage corresponding to a second sub-pixel of the pixel using the received at least one reference voltage, and generating separate gamma curves for each of the first sub-pixel and second sub-pixel;

a digital-to-analog converter receiving the first and second gamma reference voltages from the gamma unit, and generating a first gamma data value corresponding to the first sub-pixel using the first gamma reference voltage and a second gamma data value corresponding to the second sub-pixel using the second gamma reference voltage; and an output buffer outputting a first frame including the first gamma data value and a second frame including the second gamma data value, wherein the output buffer outputs the first and second frames in a repeated manner for every predetermined number of frames, wherein the output buffer outputs the first and second gamma data values by adjusting an output time duration of at least one of the first and second frames, and wherein an output frame rate is proportional to a number of gamma curves set.

8. The display device of claim 7, wherein each of the first and second sub-pixels includes a red sub-pixel, a green sub-pixel, or a blue sub-pixel.

9. The display device of claim 7, wherein the at least one reference voltage includes a first gamma voltage, a second gamma voltage, a third gamma voltage, and a fourth gamma voltage.

10. The display device of claim 9, wherein the gamma unit generates the first gamma voltage using an analog driving voltage, generates the second gamma voltage and the third gamma voltage using a half of the analog driving voltage, generates the fourth gamma voltage using a ground voltage, and generates the first and second gamma reference voltages using the generated first to fourth gamma voltages.

11. The display device of claim 7, wherein the output buffer outputs the first and second frames using a single amplifier.

12. The display device of claim 7, wherein the output buffer adjusts the output time duration of the at least one of the first and second frames in a unit of three frames, and outputs the first and second gamma data values by adjusting the output time duration of the at least one of the first and second frames.

13. A method of driving a display device including an output buffer, the method comprising:

receiving at least one reference voltage, and generating a first gamma reference voltage corresponding to a first sub-pixel of a pixel and a second gamma reference voltage corresponding to a second sub-pixel of the pixel using the received at least one reference voltage;

generating a first gamma data value corresponding to the first sub-pixel using the first gamma reference voltage and a second gamma data value corresponding to the second sub-pixel using the second gamma reference voltage based on separately set gamma curves for the first sub-pixel and the second sub-pixel; and outputting a first frame including the first gamma data value and a second frame including the second gamma data value, wherein the first and second frames are output in a repeated manner for every predetermined number of frames, wherein the output buffer outputs the first and second frames using a single amplifier, and wherein an output frame rate of the single amplifier is proportional to a number of gamma curves set.

14. A data driver comprising:

a gamma unit receiving at least one reference voltage, and generating a first gamma reference voltage, a second gamma reference voltage, and a third gamma reference voltage respectively corresponding to a first sub-pixel, a second sub-pixel and a third sub-pixel of a pixel using the received at least one reference voltage, and generating separate gamma curves for each of the first sub-pixel, second sub-pixel and third sub-pixel, wherein the first sub-pixel, the second sub-pixel and the third sub-pixel respectively, correspond to image data having a same grayscale value;

a digital-to-analog converter receiving the first gamma reference voltage, the second gamma reference voltage, and the third gamma reference voltage from the gamma unit, and generating a first gamma data value corresponding to the first sub-pixel using the first gamma reference voltage, a second gamma data value corresponding to the second sub-pixel using the second gamma reference voltage, and a third gamma data value corresponding to the third sub-pixel using the third gamma reference voltage; and an output buffer outputting a first frame including the first gamma data value, a second frame including the second gamma data value, and a third frame including the third gamma data value, wherein the first frame, the second frame and the third frame are disposed in a sequential manner, wherein the output buffer outputs the first, second and third frames using a single amplifier, and wherein an output frame rate of the single amplifier is proportional to a number of gamma curves set.

15. The data driver of claim 14, wherein the output buffer outputs the first frame, the second frame and the third frame in a repeated manner for every predetermined number of frames.

16. The data driver of claim 14, wherein the output buffer outputs the first frame, the second frame, and the third frame using a single amplifier.

17. The data driver of claim 14, wherein the output buffer outputs the first and second gamma data values by adjusting an output time duration of at least one of the first frame, the second frame and the third frame.

18. The data driver of claim 14, wherein the first sub-pixel, second sub-pixel and third sub-pixel represent different colors from each other.

* * * * *